US008757185B1

(12) United States Patent
Muzzio

(10) Patent No.: US 8,757,185 B1
(45) Date of Patent: Jun. 24, 2014

(54) BIMINI TOPS FOR WATERCRAFTS

(71) Applicant: Matthew D. Muzzio, Land O'Lakes, FL (US)

(72) Inventor: Matthew D. Muzzio, Land O'Lakes, FL (US)

( * ) Notice: Subject to any disclaimer, the term of this patent is extended or adjusted under 35 U.S.C. 154(b) by 0 days.

(21) Appl. No.: 14/075,492

(22) Filed: Nov. 8, 2013

Related U.S. Application Data

(60) Provisional application No. 61/861,900, filed on Aug. 2, 2013.

(51) Int. Cl.
*E04H 15/06* (2006.01)
*B63B 17/02* (2006.01)

(52) U.S. Cl.
USPC ..... 135/88.01; 114/361

(58) Field of Classification Search
USPC ..... 135/88.01; 43/1–3; 114/361
See application file for complete search history.

(56) References Cited

U.S. PATENT DOCUMENTS

| | | | | |
|---|---|---|---|---|
| 2,797,697 | A * | 7/1957 | Gilmore, Jr. et al. | 114/361 |
| 4,075,723 | A * | 2/1978 | Bareis et al. | 114/361 |
| 4,560,196 | A | 12/1985 | Carter, Sr. | |
| 4,683,900 | A | 8/1987 | Carmichael | |
| 5,697,320 | A | 12/1997 | Murray | |
| 5,927,311 | A | 7/1999 | Jager | |
| 6,789,495 | B2 * | 9/2004 | Brower et al. | 114/361 |
| 7,690,390 | B2 | 4/2010 | Hopkins et al. | |
| 7,921,797 | B2 | 4/2011 | James | |
| 7,946,373 | B2 | 5/2011 | Gibson | |
| 7,984,686 | B1 | 7/2011 | Solorzano | |
| 8,087,423 | B2 * | 1/2012 | Knipschild | 135/125 |
| 2008/0048413 | A1 | 2/2008 | Salinas et al. | |
| 2011/0108078 | A1 * | 5/2011 | Roman et al. | 135/121 |

* cited by examiner

*Primary Examiner* — Noah Chandler Hawk
(74) *Attorney, Agent, or Firm* — Nilay J. Choksi; Smith & Hopen, P.A.

(57) ABSTRACT

A stable rigid frame canopy being collapsible, adjustable, and capable of providing full body coverage without restricting a user's ability to enter, exit, and row a small watercraft. The canopy includes an outer support frame, and inner transverse support frame, and a canopy cover. The outer support frame has a cross frame design to increase stability. The inner transverse support frame can be longitudinally adjustable to alter the shaded region.

17 Claims, 8 Drawing Sheets

BIMINI TOPS FOR WATERCRAFTS

CROSS-REFERENCE TO RELATED APPLICATIONS

This nonprovisional application is a continuation of and claims priority to provisional application No. 61/861,900, entitled "Kayak Canopy", filed Aug. 2, 2013 by the same inventor.

BACKGROUND OF THE INVENTION

1. Field of the Invention

This invention relates, generally, to Bimini tops. More specifically, it relates to removable and foldable canopies for kayaks, canoes, paddleboats, personal watercrafts, and similar watercrafts and land vehicles, such as motorcycles.

2. Brief Description of the Prior Art

Pleasure boating has been ever increasing in popularity, and naturally users want to be comfortable and safe while engaging in these pleasurable activities. The peak seasons for pleasure boating generally are the months of summer, fall, and spring, depending on location, which tend to be hotter and sunnier than the other months. Further, many of the smaller watercrafts require physical exertion from the user and have open tops. The exposure to direct sunlight for extended periods of time, especially during the hot summer months, can be both uncomfortable and dangerous.

Some larger watercrafts have shade-providing structures, such as awnings to provide shade to the users. Smaller watercrafts tend to lack such shade-providing structures. This drawback is mostly due to the lack of support structures and surface area on the watercraft that are necessary to attach a rigid shade-providing structure that is capable of withstanding wind, waves, and other environmental factors. To address these concerns, the prior art has attempted to describe certain apparatuses for providing a smaller watercraft with a shade-providing structure, such as a canopy.

For example, U.S. Pat. No. 4,683,900 to Carmichael provides a rigid, collapsible canopy containing two support legs on either side of the canopy frame that come together and connect to the vehicle at a single point on the vehicle itself on the respective sides of the user sitting area. The canopy is attached so that the longest side or its longitudinal extent runs perpendicular to the direction of travel. Carmichael lacks an extended and adjustable canopy design and restricts a user's ability to row, enter, and exit on the side a small watercraft.

U.S. Pat. No. 7,690,390 to Hopkins, et al. describes a canopy system having outer support frames and inner transverse cross frames capable of receiving a flexible canopy fabric. Hopkins also contains a rectangular fabric canopy attached to the roughly parallel outer support frames. The outer support frames of Hopkins are positioned parallel to one another and parallel to the direction of travel. Thus, any sharp movements or environmental factors that affect the sides of the vehicle would place destabilizing force on the canopy, which would risk tipping or falling off of the vehicle. Similarly. U.S. Pat. No. 4,560,196 to Carter; U.S. Pat. No. 7,984,686 to Solorzano; U.S. Pat. No. 5,927,311 to Jager, U.S. Patent Application Pub. No. 2008/0048413 to Salinas et al.; and U.S. Pat. No. 7,946,373 to Gibson each describe a canopy system having outer support frames and inner transverse cross frames capable of receiving a flexible canopy fabric. However, each of these apparatuses suffer from the same drawbacks as Hopkins et al., namely that their outer support frames are generally parallel to one another or otherwise do not include a structure or mechanism that sufficiently supports the canopy during stress.

Accordingly, what is needed is a stable and rigid frame canopy, for use on small watercrafts and/or land vehicles, being collapsible, adjustable, and capable of providing full body coverage without restricting a user's ability to operate the vehicle, including during times of stress (e.g., wind, waves, etc.). However, in view of the art considered as a whole at the time the present invention was made, it was not obvious to those of ordinary skill in the field of this invention how the shortcomings of the prior art could be overcome.

All referenced publications are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing but heretofore unfulfilled need for stable rigid frame canopy being collapsible, adjustable, and capable of providing full body coverage without restricting a user's ability to enter, exit, and row a small watercraft is now met by a new, useful, and nonobvious invention.

In an embodiment, the current invention is a canopy apparatus for a vehicle. The apparatus includes an outer support frame that has two (2) elongate outer support members, each having two (2) distinct points of connection with the vehicle, thus forming four (4) distinct points of connection between the apparatus and the vehicle. The outer support members are oblique to each other, such that they cross each other at least once at an intersection or crossing point. There is a spaced distance between the crossing point and the corresponding points of connection of the outer support members to the vehicle thereunder. The apparatus further includes an inner transverse frame that extends between the outer support members to connect the outer support members to each other for stability. A canopy cover is attached to the outer support frame for shading the user of the vehicle thereunder.

The outer support members may further include interconnected longitudinal members formed of a resilient material. In a further embodiment, a slip connector can be used between two (2) adjacent longitudinal members to secure the two members together. In a further embodiment, the longitudinal members and slip connectors may have a hollow cross-section, such that a shock cord can be disposed therethrough. The shock cord would be secured to each end of each outer support members and have a length shorter than or equal to the length of each support member when there is no tension force on the shock cord.

The inner transverse frame may further include tee connectors on each end of the frame to secure each end of the frame to each respective outer support member. In a further embodiment, the inner transverse frame may further include interconnected inner transverse support members formed of a resilient material. In a further embodiment, a slip connector can be used between two (2) adjacent inner transverse members to secure the two members together. In a further embodiment, the inner transverse members and slip connectors may have a hollow cross-section, such that a shock cord can be disposed therethrough. The shock cord would be secured to each end of the inner transverse frame and have a length shorter than or equal to the length of the inner transverse frame when there is no tension force on the shock cord.

In an alternate embodiment, the tee connectors may include a base channel and an inwardly extending channel. The base channel communicates with the outer support members and have a cross-section large enough to allow the tee connectors to slide longitudinally along the outer support members. The inwardly extending channel communicates with the inner transverse frame. When opposing tee connectors slide along the outer support members, the arc of the canopy cover would change according to the needs of the user operating the vehicle.

A cross connector may communicate with the outer support members at the intersection or crossing point of the outer support members in order to secure the outer support members in an oblique orientation with rest to each other.

The canopy apparatus may further include four (4) receptacles that are secured to the vehicle, where the four (4) receptacles correspond to the four (4) distinct points of connection between the canopy apparatus and the vehicle. An end of each outer support member would be inserted or otherwise secured within each receptacle to secure the canopy apparatus to the vehicle. In a further embodiment, each end of each outer support members can have a roughly cylindrical, semi-malleable head. In a further embodiment, each head would be formed of a material having a density less than water. Thus, if the canopy apparatus becomes disjoined from the vehicle, it can float on the water for retrieval.

The canopy apparatus may further include an additional intersection or crossing point between the outer support members at a position that is substantially opposite from the initial intersection or crossing point (the term "substantially opposite" referring to the other side of the canopy apparatus along the longitudinal extent of the canopy apparatus). This additional intersection or crossing point would also be positioned at a spaced distance above the corresponding points of connection of the outer support members to the vehicle thereunder.

The outer support frame may have a longitudinal axis that is parallel to a path of travel of the vehicle or parallel to a longitudinal extent of the vehicle. Typically, this would mean that the connection points of the canopy apparatus are at the front and rear of the vehicle.

In a separate embodiment, the current invention is a canopy apparatus for a kayak or similar small watercraft. The canopy apparatus includes an outer support frame formed of two (2) elongate outer support members, each having two (2) distinct points of connection with the vehicle, thus forming four (4) distinct points of connection between the apparatus and the vehicle. The outer support members are oblique to each other. The outer support frame has a longitudinal axis that parallel to a path of travel of the vehicle and parallel to a longitudinal extent of the vehicle. The outer support members are formed of interconnected longitudinal members that have a hollow cross-section. A longitudinal slip connector secures two (2) of the longitudinal members to one another. The longitudinal slip connector also has a hollow cross-section. A shock cord can be disposed through the hollow cross-sections of the longitudinal members and slip connectors of each outer support member. The shock cord would be secured to each end of each outer support members and have a length shorter than or equal to the length of each support member when there is no tension force on the shock cord. Four (4) receptacles are secured to the vehicle corresponding to the four (4) distinct points of connection between the canopy apparatus and vehicle. The outer support members can have ends that each include a roughly cylindrical, semi-malleable head that is inserted or otherwise secured within each receptacle to secure the canopy apparatus to the vehicle. Each head is formed of a material having a density less than water. Thus, if the canopy apparatus becomes disjoined from the vehicle, it can float on the water for retrieval. The outer support members are oblique in a manner such that they have an intersection or crossing point proximal to each end of the outer support members. Thus, there are two (2) crossing points that are each positioned at a spaced distance above the vehicle and connection points between the canopy apparatus and the vehicle. A cross connector is positioned at each crossing point to secure the outer support members to each other in an oblique position at the crossing points. The canopy apparatus further includes an inner transverse frame that extends between the outer support frames and coupled the outer support frames to each other. The inner transverse frame includes three (3) interconnected inner transverse support members formed of a resilient material. The inner transverse frame further includes a tee connector on each end of a centermost inner transverse support member ("centermost" relative to the three (3) transverse support members). The tee connector secures each end of the centermost transverse member to the respective outer support member. The tee connector includes a base channel and an inwardly extending channel. The base channel communicates with the outer support members and have a cross-section large enough to allow the tee connectors to slide longitudinally along the outer support members. The inwardly extending channel communicates with the inner transverse frame. When opposing tee connectors slide along the outer support members, the are of the canopy cover would change according to the needs of the user operating the vehicle. The inner transverse frame further includes a transverse slip connector that secures two (2) of the interconnected transverse support members to one another. The canopy apparatus further includes a flexible canopy cover attached to the outer support frame and disposed in overlying relation to the inner transverse frame.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 1:
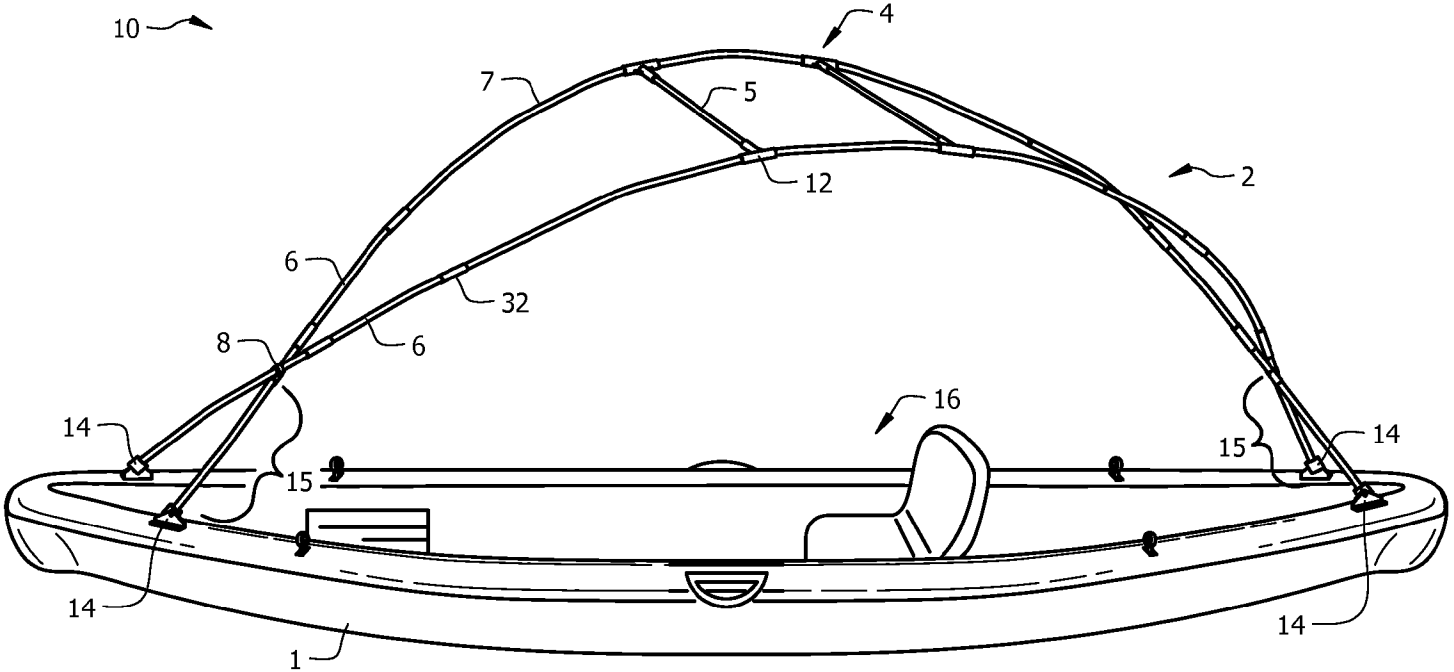
FIG. 1 is a perspective view of a canopy frame, according to an embodiment of the current invention, attached to a vehicle, such as a kayak.

In the following detailed description of the preferred embodiments, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

In an embodiment, the present invention is a canopy or Bimini top/cover for a watercraft or land vehicle. Examples include, but are not limited to kayaks, canoes, boats, personal watercrafts, water scooters, motorcycles, and all-terrain vehicles, among other vehicles where the head and/or body of the user may be exposed to sunlight. The canopy includes an outer support frame, an inner transverse frame having at least one inner transverse support member, and a flexible canopy cover. The outer support frame extends longitudinally about the vehicle in the direction of travel and has a predefined length. The length is longer than the distance between the canopy-vehicle connection points on each end of the vehicle, so that the outer support frame is arched up and away from the user sitting area within the vehicle. These canopy-vehicle connection points can be referred to as the "front" and "rear" of the vehicle, though these are relative terms of art, where it is assumed that the front and rear of the vehicle have a line of axis therebetween that is parallel to the direction of travel. The outer support frame includes two (2) outer support members that each have a connection point at the front of the vehicle and a connection point at the rear of the vehicle. The outer support members are not parallel to each other, instead having at least one intersection point where the support members cross each other at a spaced distance away from the connection points.

In an embodiment, the outer support frame includes two outer support members, where each is composed of multiple interconnected longitudinal members. The longitudinal members are tubular in design to allow for a shock cord to be disposed through the hollow cross-sections. The shock cord has a predefined length, so that the tension force on the cord aids in maintaining the interconnection of the longitudinal members. The longitudinal members are connected via slip connectors allowing for easy assembly and disassembly. When disjoined, the shock cord maintains linkage among the longitudinal members, so longitudinal member cannot be lost from a set and so the order and arrangement of the longitudinal members is maintained.

The inner transverse frame extends between the outer support members. In certain embodiments, the inner transverse frame is comprised of two or more inner transverse support members being longitudinally connected with slip connectors. The inner transverse support members can be hollow in design and attached to the outer support frame via tee connectors. In an embodiment, a shock cord is disposed through the cross section of the inner transverse support members and connected to the tee connectors that connect the inner transverse support members to the outer support members. Similarly to the shock cord in the longitudinal members of the outer frame, the shock cord disposed through the cross-section of the inner transverse support members is of a predefined length. The length would be appropriate so that the tension force on the shock cord aids in maintaining the interconnection of the inner transverse support members and the tee connectors.

The tee connector may be formed of a base channel and an inwardly extending channel that is formed roughly perpendicular to the base channel and extends toward the interior of the outer support frame of the canopy. The channels are hollow and in open communication with one another. The base channel can receive the outer support members, whereas the inwardly extending channel would receive the inner transverse support members. In an embodiment, the base channel can have a diameter large enough to allow the tee connector as a whole to slide longitudinally along the extent of the outer support member on which the tee connector is positioned. In this case, shock cord would not be present within the tee connectors. Sliding of the tee connectors along the outer support members would also allow the inner transverse support member therewith. Allowing the inner transverse support members to move in a direction along the longitudinal extent of the canopy would alter the shape and arc of the canopy cover and the shaded region.

The outer support members have an intersection or crossing point near the front end of the vehicle and/or the rear end of the vehicle (or otherwise on two opposing sides of the vehicle). The intersection or crossing point is positioned at a spaced distance above their connections, thus creating a crossing point that is not the same as the point of connection to the vehicle. The crossing point contains a cross connector to secure the outer support members. Crossing the outer support members provides increased stability without requiring additional support wires or frames. Another embodiment of the present invention contains only one crossing point within the outer support frame, typically at the front end of the vehicle. Such an embodiment allows for the use of a longer canopy cover, which can extend from the single crossing point to the canopy-vehicle attachment points opposite the crossing point. This configuration provides a more extensive shaded region for the user.

The outer support members are connected to the vehicle at attachment points, two at the front of the vehicle and two at the back. The outer support members are secured to the vehicle attachment points using a bracket and a receptacle. The brackets are secured to the vehicle, and the receptacles are secured to the bracket, such that one bracket corresponds to one receptacle. The receptacles receive the ends of the outer support members. The outer support members includes ends having a cylindrical, semi-malleable head. In an embodiment, each head may have a density that is less than the density of water to allow the outer support members to float if the canopy were to become detached from a watercraft. The heads can also include an end of the shock cord extending therethrough, where the shock cord was disposed through the apparatus. The receptacles may have a predefined inner diameter that is similar to the outer diameter of the heads in order to snugly fit the head within the receptacle to secure the head to the receptacle. This ensures that a user can insert the head with minimum force, while also allowing for easy detachment for safety purposes if the vehicle were to roll over. The current invention contemplates any other form of attachment of the outer support members to the vehicle, as is known to a person having ordinary skill in the art. In this particular embodiment, the invention uses a cylindrically shaped head and receptacle, but a person having ordinary skill in the art may also understand other shapes that offer similar benefits. In an embodiment, the current invention may include swiveling attachment points (not shown) to allow the same canopy to be used with different vehicles or on the same vehicle at different angles, as would be understand by a person having ordinary skill in the art.

A detachable handle can be disposed at either or both crossing points for stabilizing the apparatus when inserting the heads into the receptacles, thus creating the arch of the apparatus.

The outer support frame, including its outer support members, and the inner transverse frame, including its inner transverse support members, are capable of being disjoined or disengaged, such that the canopy apparatus can be folded into a compact position and stowed when not in use.

Any portion of the outer support frame and/or inner transverse frame can include one or more flotation noodles disposed therearound to assist in the flotation of the apparatus if the apparatus were to fall into a body of water. These flotation noodles can be removable from the frames.

The canopy cover is formed of any material, typically a flexible material, which is capable of blocking out sunlight. It is attached to the outer support members in a manner that allows for easy detachment and is positioned above the inner transverse frames. The inner transverse frames provide support not only to the overall frame of the canopy but also to the canopy cover that rests in overlying relation thereto.

EXAMPLE

As shown in FIG. 1, an embodiment of the present invention is a canopy apparatus generally denoted by the reference numeral 10. Canopy apparatus 10 includes outer support frame 2, two inner transverse frames 4, and flexible canopy cover 3, shown in FIG. 2. Outer support frame 2 extends longitudinally about vehicle 1 and has a predefined length that is longer than the distance between the canopy-vehicle connection points 14, on either end of vehicle 1, so that outer support frame 2 is arched up and away from user sitting area 16.

Figure 2:
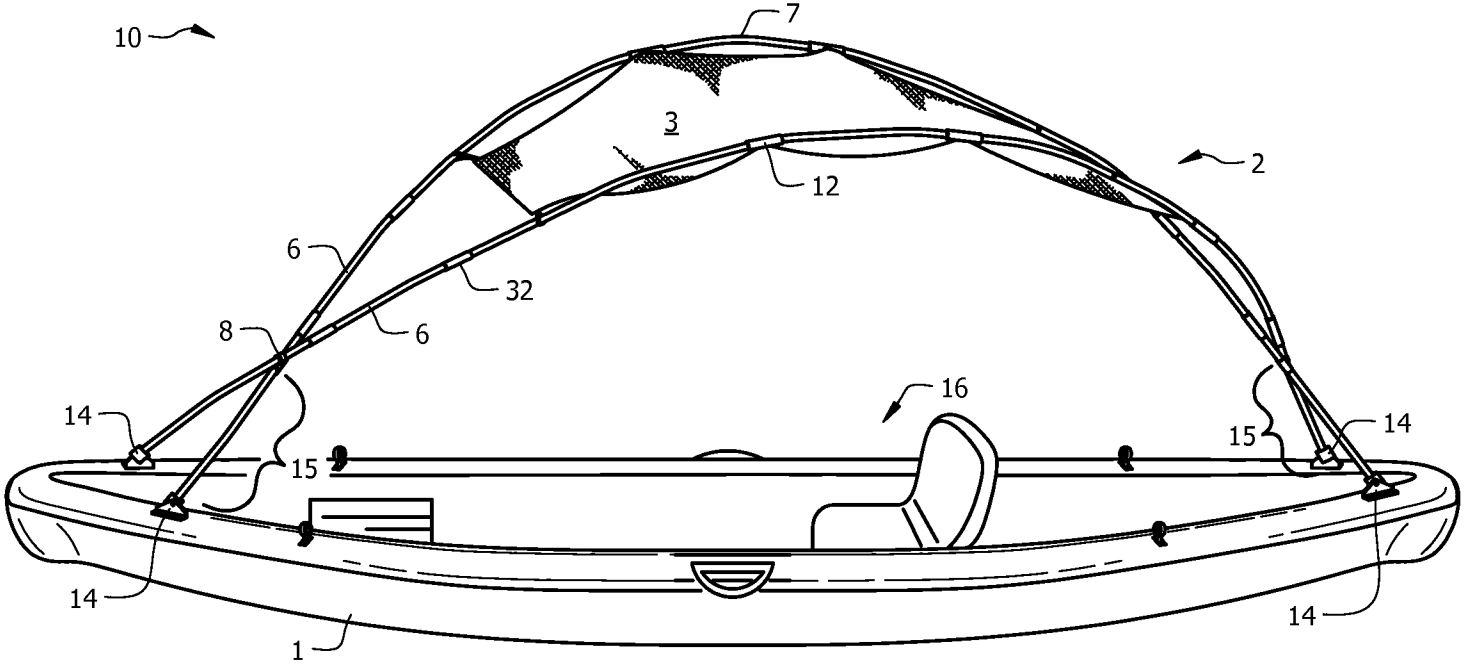
FIG. 2 is a perspective view of a canopy frame with attached canopy cover, according to an embodiment of the current invention, attached to a vehicle, such as a kayak.

As shown in FIGS. 1 and 2, outer support frame 2 includes two outer support members 6. Each support member 6 is composed of one or more longitudinal members 7 that are interconnected. Longitudinal members 7 are tubular in design to allow for a shock cord 38 to be disposed through the hollow cross-sections. Shock cord 38 is of a predefined length so that the tension force on the cord aids in maintaining the interconnection of longitudinal members 7. As seen in FIGS. 1, 2, 12 and 13, longitudinal members 7 can be connected via ferrule or slip connectors 32 that allow longitudinal members 7 to be easily connected and disjoined. When disjoined, shock cord 38 keeps longitudinal members 7 linked together so that no longitudinal member 7 can be lost from a set and so that the order of longitudinal members 7 is maintained.

Two inner transverse frames 4 extend between two outer support members 6 and connect outer support members 6 to one another so as to provide stability across outer support members 6 and provide stability to outer support frame 2. Inner transverse frames 4 are each composed of one or more inner transverse support members 5. Inner transverse support members 5 are hollow in design and can be attached to outer support frame 2 via tee connectors 12. Shock cord 38 can run from one tee connector 12 through the cross section of one inner transverse support member 5 and one outer support member 6, and be disposed within another tee connector 12 through the cross section of the opposing transverse support member 5 and the opposing outer support member 6. Shock cord 38 can exit tee connector 12 through aperture 40. Similarly to shock cord 38 in longitudinal members 7 of outer frame 2, shock cord 38 extending through tee connectors 12 and the cross-section of inner transverse support members 5 and outer support members 6 is of a predefined length so that the tension force on shock cord 38 aids in maintaining the interconnection of the inner transverse support members and tee connectors 12.

Figure 3:
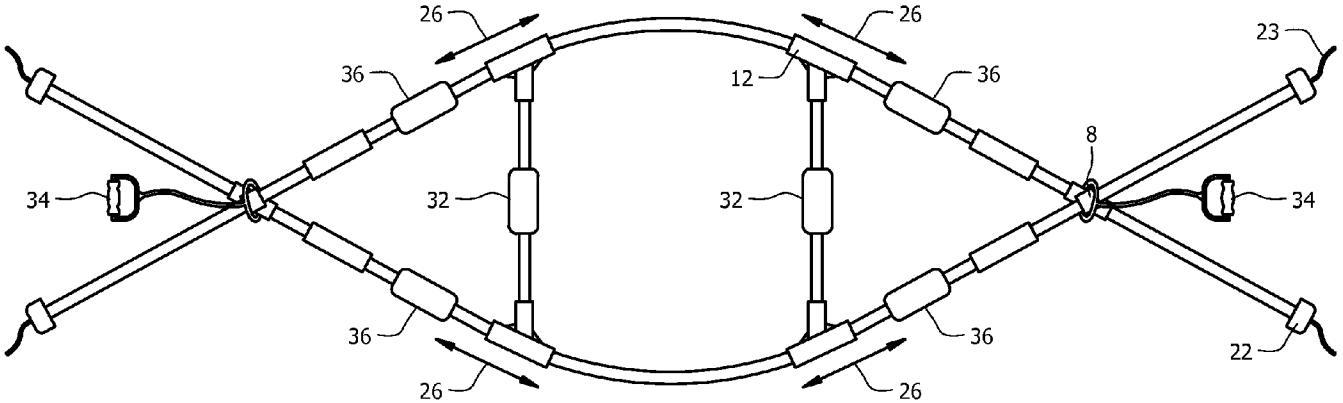
FIG. 3 is a top view of a canopy frame with slidably adjustable tee connectors and corresponding transverse cross supports.
Figure 4:
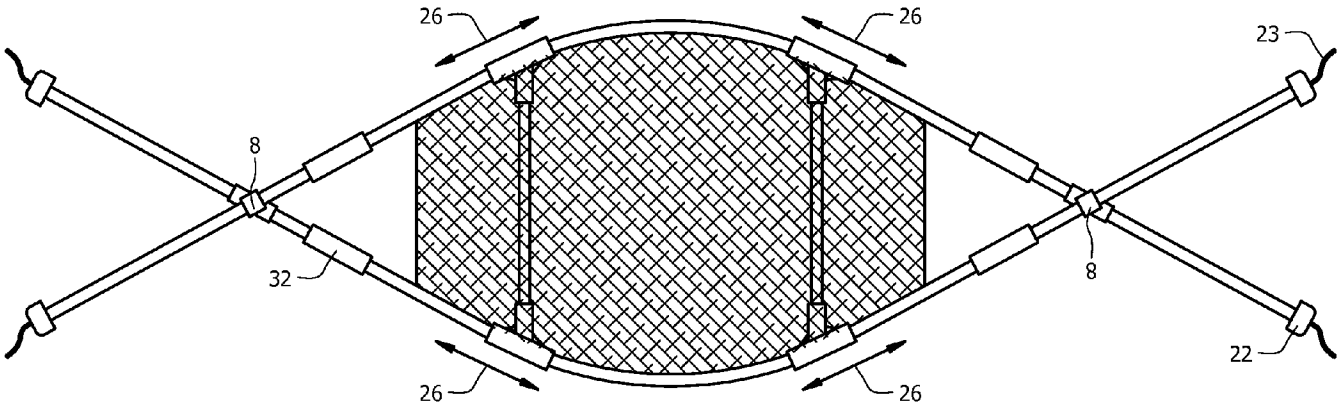
FIG. 4 is a top view of the canopy frame of FIG. 3 with the addition of a canopy cover.
Figure 10:
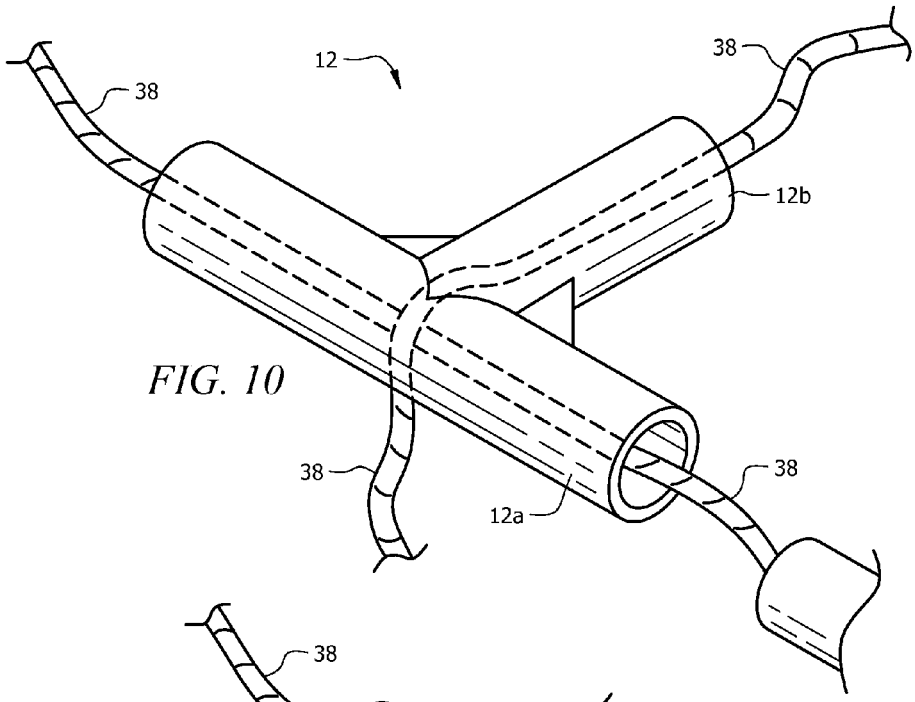
FIG. 10 is a rear perspective view of a tee connector according to an embodiment of the current invention.
Figure 11:
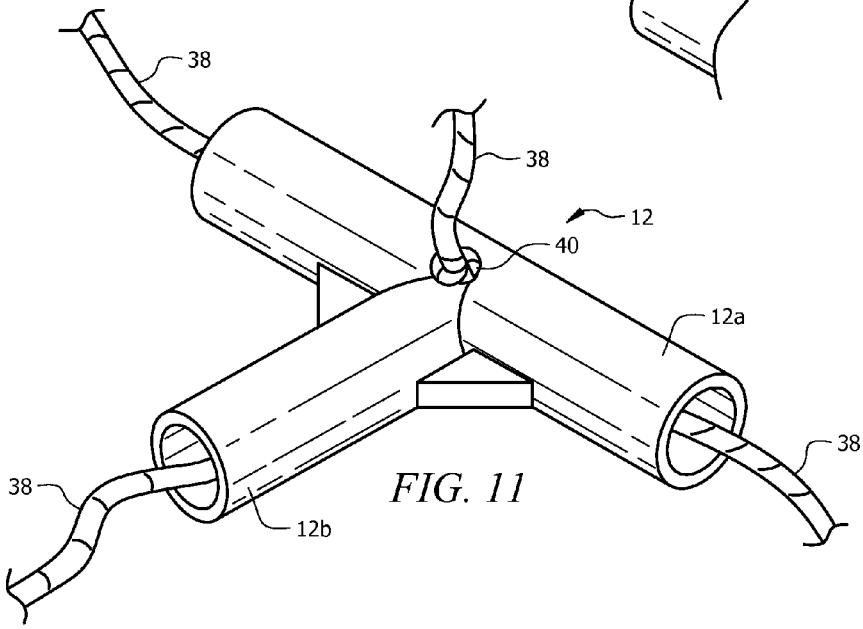
FIG. 11 is a front perspective view of the tee connector of FIG. 10.
Figure 12:
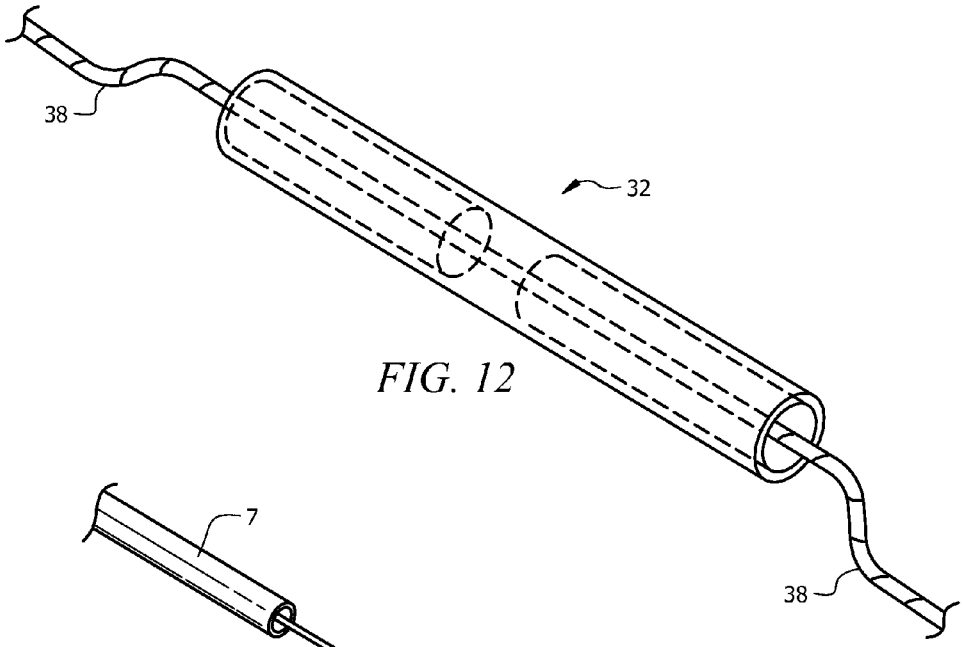
FIG. 12 is a perspective view of a slip connector with longitudinal members of an outer support frame therewithin.
Figure 13:
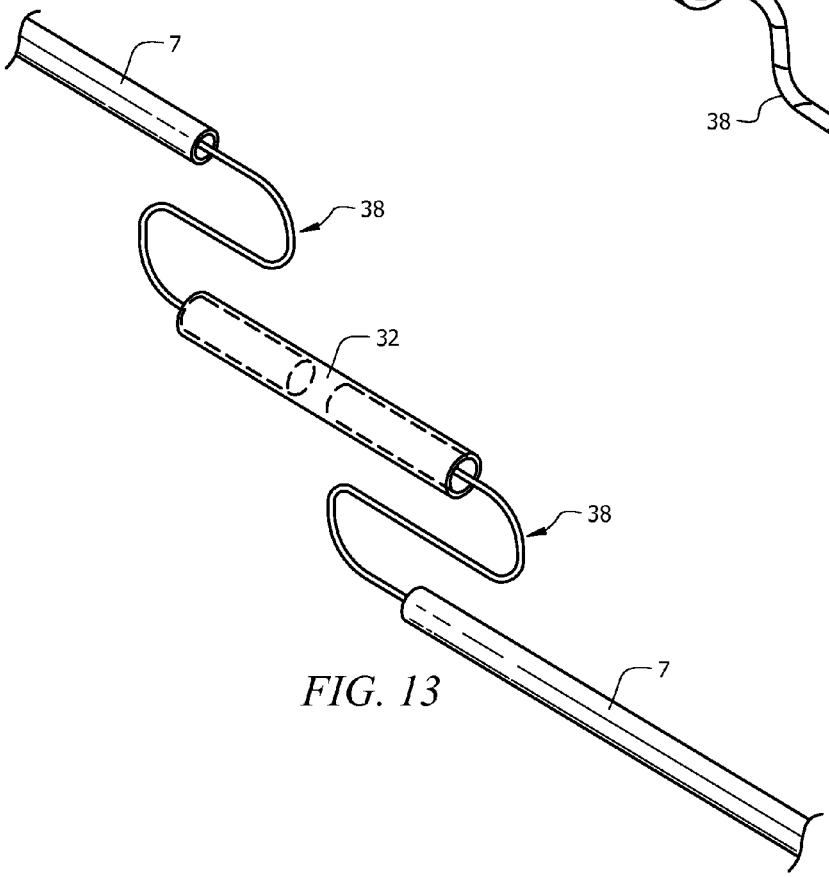
FIG. 13 is an assembly view of a connection between a slip connector and longitudinal members of an outer support frame.

As seen in FIGS. 10 and 11, tee connector 12 may be formed of base channel 12*a* and inwardly extending channel 12*b* that is formed roughly perpendicular to base channel 12*a* and extends toward the interior of outer support frame 2 of canopy 10. Channels 12*a*, 12*b* are hollow and in open communication with one another, such that shock cord 38 can be positioned therethrough, if needed. Base channel 12*a* can receive outer support members 6, whereas inwardly extending channel 12*b* would receive inner transverse support members 5. In an embodiment, as seen in FIGS. 3 and 4, base channel 12*a* can have a diameter large enough to allow tee connectors 12 as a whole to move longitudinally along the extent of outer support member 6 on which tee connector 12 is positioned. In this case, shock cord 38 may not be present within the tee connectors. Alternatively, shock cord 38 would be present but would exit tee connector 12 through aperture 40 prior to reaching outer support members 6. Sliding of the tee connectors along the outer support members would also allow the inner transverse support member therewith. Allowing inner transverse support members 5 to move in a direction, shown by arrows 26 in FIGS. 3 and 4, longitudinal to canopy apparatus 10 would alter the shape and arc of canopy cover 3 and therefore the shape of the shaded region over user sitting area 16.

Figure 8:
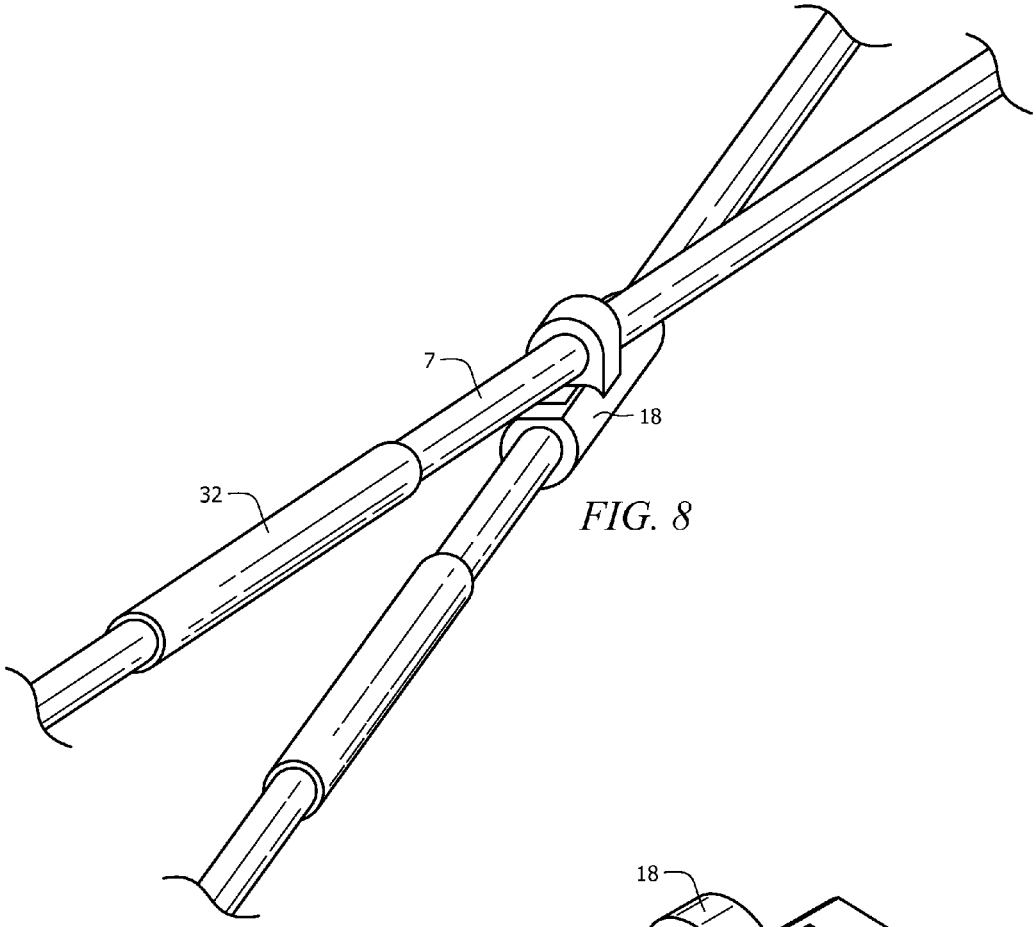
FIG. 8 is a close-up view of an embodiment of a cross connector securing outer support members at their point of intersection.
Figure 9:
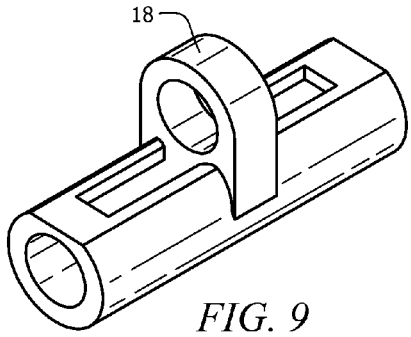
FIG. 9 is a close-up view of the cross connector of FIG. 8 without the outer support members engaged therein.

Outer support members 6 have an intersection or crossing point 8 near the front end of vehicle 1 and/or the rear end of vehicle 1, though it is contemplated that crossing point 8 can be on any opposing sides of vehicle 1. If only one (1) crossing point is present, then that crossing point is typically at the front of the vehicle. Regardless, crossing point 8 is not the same as the point of connection 14 to vehicle 1. Crossing point 8 would actually be positioned at a spaced distance 15 away from or above connection points 14. As seen in FIGS. 8 and 9, each crossing point 8 contains cross connector 18 to secure outer support members 6 to one another at crossing point 8.

Figure 5:
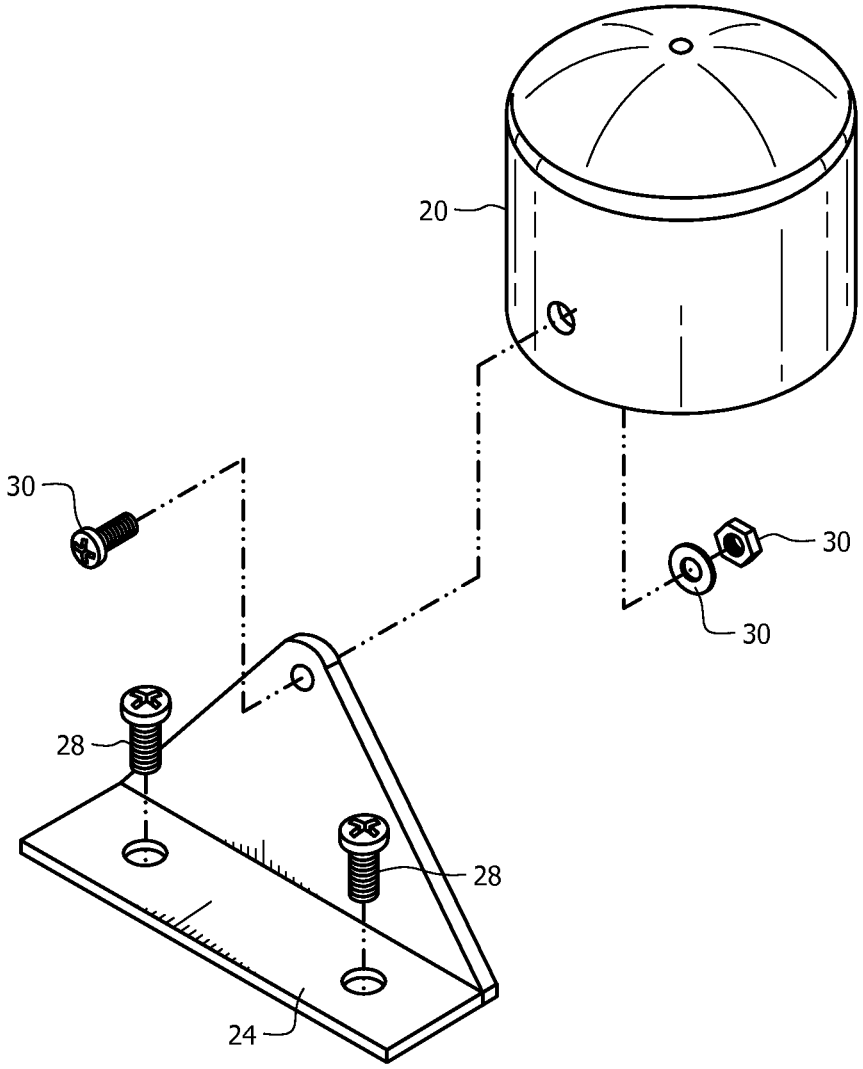
FIG. 5 is a close-up view of an assembly of a bracket and receptacle, as would be secured to a vehicle.
Figure 6:
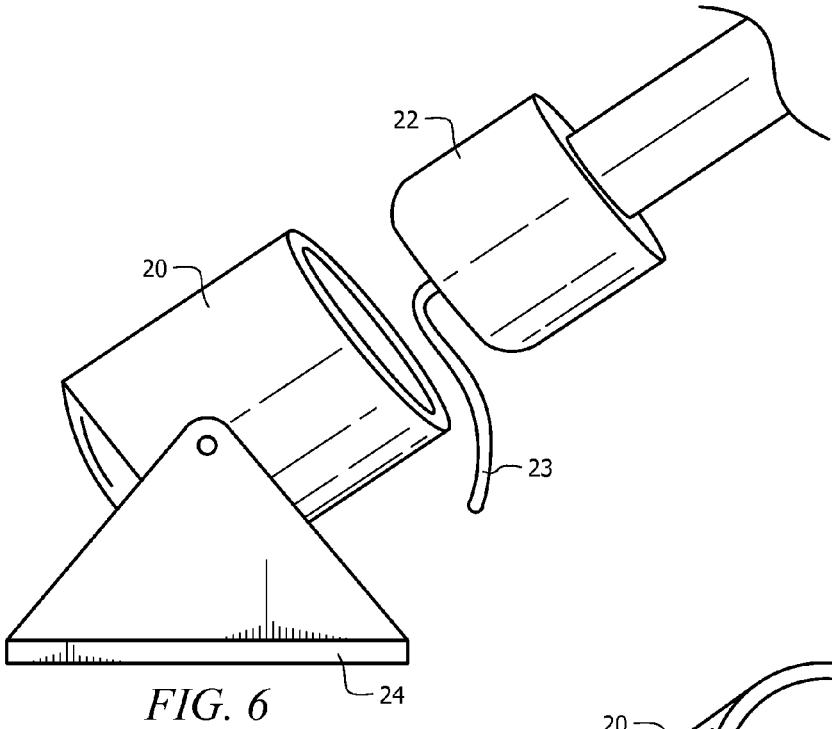
FIG. 6 is close-up view of an attachment point just before insertion of a head of an outer support frame into a receptacle that would be secured to a vehicle.
Figure 7:
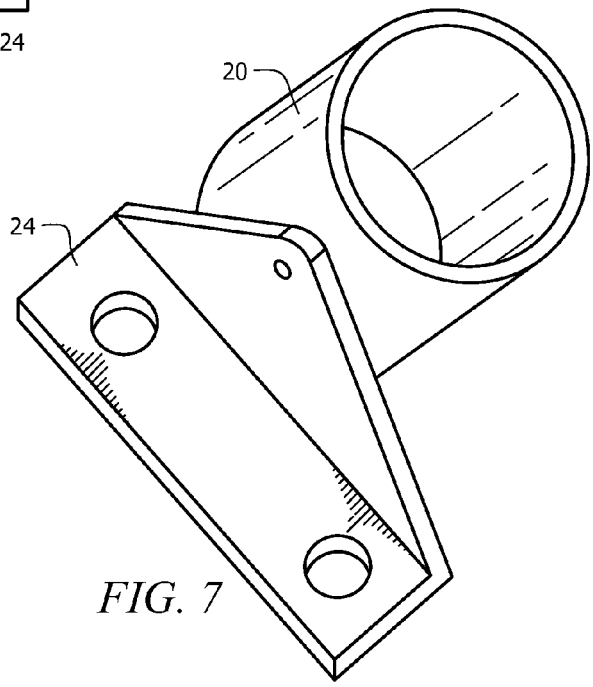
FIG. 7 is close-up perspective view of the bracket and receptacle of FIG. 6.

Outer support members 6 are connected to vehicle 1 at attachment points 14, as shown in FIGS. 1 and 2. In this embodiment, there are two attachment points 14 at the front of vehicle 1 and two attachment points 14 at the rear of vehicle 1. As shown in FIGS. 5-7, outer support members 6 are secured to vehicle 1 at attachment points 14 using a bracket 24 secured 30 to receptacle 20. Brackets 24 are attached 28 to vehicle 1, and receptacles 20 receive outer support members 6. Outer support members 6 contain ends having a cylindrical, semi-malleable head 22. Heads 22 show end 23 of shock cord 38 that was disposed through apparatus 10. Receptacles 20 may have a predefined inner diameter that is similar to the outer diameter of heads 22 in order to snugly fit head 22 within receptacle 20 to secure head 22 to receptacle 22.

Detachable handle 34 can be disposed at either or both crossing points 8 for stabilizing apparatus 10 when inserting heads 22 into receptacles 20, thus creating the arch of apparatus 10.

Any portion of outer support frame 2 and/or inner transverse frame 4 can include one or more flotation noodles 36 disposed therearound to assist in the flotation of apparatus 10 if apparatus 10 were to fall into a body of water. Flotation noodles 36 can be removable from frames 2, 4. Additionally, flotation noodles 36 can have a neon coloring for ease of visibility.

Canopy cover 3 is attached to outer support members 6 and disposed on top of inner transverse frames 4, as shown in FIG. 4. Canopy cover 3 is located above user sitting area 16 and longitudinally within crossing points 8 at the front and rear of vehicle 1.

GLOSSARY OF CLAIM TERMS

Canopy Cover: is a shade-providing body of fabric or flexible material.

Cross Connector: is a structure that is used to secure the outer support members and provides increased stability without requiring additional support wires or frames.

Head: is a semi-malleable end piece to the outer support members that allows the outer support members to be received and secured by a receptacle of a similar size and shape.

Receptacle: is a device for receiving the heads of the outer support members to secure the connection of the outer support frame to the vehicle.

Shock Cord: is an elastic cord or wire that can be disposed through the support members the frames and has a predefined length, such that the tension force on the shock cord can aid in maintaining the interconnection of the support members and the connectors.

Slip Connector: is a structure forming a connection by sliding one part over another of nearly the same size and uniting the two.

Spaced Distance: is a length or distance between the intersection or crossing point of the outer support members and the point of connection to the vehicle that is greater than zero, thus creating a crossing point that is not the same as the point of connection to the vehicle.

Tee Connector: is a structure in the shape of a "T" that is used to connect the outer support members and the inner transverse support members.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A canopy apparatus for a vehicle, comprising:

an outer support frame having a first elongate outer support member and a second elongate outer support member, each of said first and second outer support members having two (2) distinct points of connection with said vehicle to form four (4) distinct points of connection between said canopy apparatus and said vehicle, said first and second outer support members having longitudinal extents that are oblique to each other;

an off-center intersection or crossing point between said first outer support member and said second outer support member, said first and second outer support members being secured to one another at a spaced distance above their corresponding points of connection to said vehicle;

a resilient cross connector that secures said first elongate outer support member and said second elongate outer support member to each other at said intersection or crossing point, said cross connector having a first channel that receives said first elongate outer support member and a second channel that receives said second elongate outer support member, said first channel and said second channel having an inherent bias toward being disposed in parallel relation to each other, said second channel capable of twisting relative to said first channel such that said first and second elongate outer support members can be positioned oblique to one another, said second channel having a length shorter than a length of said first channel;

an inner transverse frame extending between said first and second outer support members at a position proximal to an apex of said canopy apparatus with said intersection or crossing point being distal to said apex of said canopy apparatus, said inner transverse frame coupling said first outer support member to said second outer support member; and a canopy cover capable of attachment to said outer support frame.

2. A canopy apparatus as in claim 1, further comprising:

said outer support members further including interconnected longitudinal members formed of a resilient material.

3. A canopy apparatus as in claim 2, further comprising:

a slip connector that secures two (2) of said interconnected longitudinal members to one another.

4. A canopy apparatus as in claim 3, further comprising:

said longitudinal members having a hollow cross-section and said slip connectors also having a hollow cross-section;

a shock cord disposed through said hollow cross-sections of said longitudinal members and said slip connectors of each of said outer support members, said shock cord being secured to each end of said each outer support member and having a length shorter than or equal to a length of said each outer support member when there is no tension force on said shock cord.

5. A canopy apparatus as in claim 1, further comprising:

said inner transverse frame further including tee connectors on each end of said inner transverse frame securing said each end of said inner transverse frame to each respective outer support member.

6. A canopy apparatus as in claim 5, further comprising:

said inner transverse frame further including interconnected inner transverse support members formed of a resilient material.

7. A canopy apparatus as in claim 6, further comprising:

a slip connector that secures two (2) of said interconnected inner transverse support members to one another.

8. A canopy apparatus as in claim 7, further comprising:

said transverse support members having a hollow cross-section and said slip connectors also having a hollow cross-section;

a shock cord disposed through said hollow cross-sections of said transverse support members and said slip connectors of each of said inner transverse frame, said shock cord being secured to each end of said inner transverse frame and having a length shorter than or equal to a length of said inner transverse frame when there is no tension force on said shock cord.

9. A canopy apparatus as in claim 5, further comprising:

said tee connectors further including a base channel and an inwardly extending channel, said base channel communicating with said outer support members and having a cross-section large enough to allow said tee connectors to slide longitudinally along said outer support members, said inwardly extending channel communicating with said inner transverse frame, wherein sliding opposing tee connectors along said first and second outer support members changes an arc of said canopy cover.

10. A canopy apparatus as in claim 1, further comprising:

a cross connector communicating with said first and second outer support members and securing said first and second outer support members in an oblique orientation with respect to each other at said intersection or crossing point.

11. A canopy apparatus as in claim 1, further comprising:

four (4) receptacles secured to said vehicle, said receptacles corresponding to said four (4) distinct points of connection between said canopy apparatus and said vehicle, said first and second outer support members each having a first end and a second end that are secured to said four (4) receptacles.

12. A canopy apparatus as in claim 11, further comprising:

said first end of said first and second outer support members having a first roughly cylindrical, semi-malleable head, said second end of said first and second outer support members having a second roughly cylindrical, semi-malleable head, wherein each of said first and second heads of said first and second outer support members are inserted into and secured within each of said four (4) receptacles.

13. A canopy apparatus as in claim 12, further comprising:

said first and second heads being formed of a material having a density less than water.

14. A canopy apparatus as in claim 1, further comprising:

an additional intersection or crossing point between said first outer support member and said second outer support member at a position substantially opposite from said intersection or crossing point, said first and second outer support members being secured to one another at an additional spaced distance above their corresponding points of connection to said vehicle.

15. A canopy apparatus as in claim 1, further comprising:

said outer support frame having a longitudinal axis that is parallel to a path of travel of said vehicle or parallel to a longitudinal extent of said vehicle.

16. A canopy apparatus for a kayak or similar small watercraft, comprising:

an outer support frame having a first elongate outer support member and a second elongate outer support member, each of said first and second outer support members having two (2) distinct points of connection with said watercraft to form four (4) distinct points of connection between said canopy apparatus and said watercraft, said first and second outer support members having longitudinal extents that are oblique to each other, said outer support frame having a longitudinal axis that is parallel to a path of travel of said watercraft and parallel to a longitudinal extent of said watercraft, said outer support members further including interconnected longitudinal members formed of a resilient material, said longitudinal members having a hollow cross-section;

a longitudinal slip connector that secures two (2) of said interconnected longitudinal members to one another, said slip connectors also having a hollow cross-section;

a shock cord disposed through said hollow cross-sections of said longitudinal members and said slip connectors of each of said outer support members, said shock cord being secured to each end of said each outer support member and having a length shorter than or equal to a length of said each outer support member when there is no tension force on said shock cord;

four (4) receptacles secured to said watercraft, said receptacles corresponding to said four (4) distinct points of connection between said canopy apparatus and said watercraft, said first and second outer support members each having a first end and a second end, said first end of said first and second outer support members having a first roughly cylindrical, semi-malleable head, said second end of said first and second outer support members having a second roughly cylindrical, semi-malleable head, wherein each of said first and second heads of said first and second outer support members are inserted into and secured within each of said four (4) receptacles, said first and second heads being formed of a material having a density less than water, a first intersection or crossing point between said first outer support member and said second outer support member, said first and second outer support members being secured to one another at a first spaced distance above their corresponding points of connection to said watercraft;

a second intersection or crossing point between said first outer support member and said second outer support member at a position substantially opposite from said intersection or crossing point, said first and second outer support members being secured to one another at a second spaced distance above their corresponding points of connection to said watercraft;

a cross connector communicating with said first and second outer support members and securing said first and second outer support members in an oblique orientation with respect to each other at said first and second intersection or crossing points;

three (3) inner transverse frames extending between said first and second outer support members, said inner transverse frames coupling said first outer support member to said second outer support member, said three (3) inner transverse frames formed of a resilient material, a tee connector on each end of a centermost inner transverse frame, said tee connector securing said each end of said centermost inner transverse frame to each respective outer support member, said tee connector further including a base channel and an inwardly extending channel, said base channel communicating with said outer support members and having a cross-section large enough to allow said tee connectors to slide longitudinally along said outer support members, said inwardly extending channel communicating with said centermost inner transverse frame, wherein sliding opposing tee connectors along said first and second outer support members changes an arc of said canopy cover; and a flexible canopy cover attached to said outer support frame and disposed in overlying relation to said inner transverse frames.

17. A canopy apparatus for vehicle, comprising:

an outer support frame having a first elongate outer support member and a second elongate outer support member, each of said first and second outer support members having two (2) distinct points of connection with said watercraft to form four (4) distinct points of connection between said canopy apparatus and said watercraft, said first and second outer support members having longitudinal extents that are oblique to each other, said outer support frame having a longitudinal axis that is parallel to a path of travel of said watercraft and parallel to a longitudinal extent of said watercraft, said outer support members further including interconnected longitudinal members formed of a resilient material, said longitudinal members having a hollow cross-section;

a longitudinal slip connector that secures two (2) of said interconnected longitudinal members to one another, said slip connectors also having a hollow cross-section;

a shock cord disposed through said hollow cross-sections of said longitudinal members and said slip connectors of each of said outer support members, said shock cord being secured to each end of said each outer support member and having a length shorter than or equal to a length of said each outer support member when there is no tension force on said shock cord;

four (4) receptacles secured to said watercraft, said receptacles corresponding to said four (4) distinct points of connection between said canopy apparatus and said watercraft, said first and second outer support members each having a first end and a second end, said first end of said first and second outer support members having a first roughly cylindrical, semi-malleable head, said second end of said first and second outer support members having a second roughly cylindrical, semi-malleable head, wherein each of said first and second heads of said first and second outer support members are inserted into and secured within each of said four (4) receptacles, said first and second heads being formed of a material having a density less than water;

a first intersection or crossing point between said first outer support member and said second outer support member, said first and second outer support members being secured to one another at a first spaced distance above their corresponding points of connection to said watercraft;

a second intersection or crossing point between said first outer support member and said second outer support member at a position substantially opposite from said intersection or crossing point, said first and second outer support members being secured to one another at a second spaced distance above their corresponding points of connection to said watercraft;

a cross connector communicating with said first and second outer support members and securing said first and second outer support members in an oblique orientation with respect to each other at said first and second intersection or crossing points;

a transverse frame extending between said first and second outer support members, said inner transverse frame coupling said first outer support member to said second outer support member, said inner transverse frame formed of a resilient material, a tee connector on each end of said inner transverse frame, said tee connector securing said each end of said inner transverse frame to each respective outer support member, said tee connector further including a base channel and an inwardly extending channel, said base channel communicating with said outer support members and having a cross-section large enough to allow said tee connectors to slide longitudinally along said outer support members, said inwardly extending channel communicating with said centermost inner transverse frame, wherein sliding opposing tee connectors along said first and second outer support members changes an arc of said canopy cover, and a flexible canopy cover attached to said outer support frame and disposed in overlying relation to said inner transverse frame.

* * * * *